United States Patent [19]

Wisbrock

[11] 4,212,358

[45] Jul. 15, 1980

[54] POSTHOLE DIGGING APPARATUS

[76] Inventor: Kenneth R. Wisbrock, c/o Valley Construction & Fencing, 68 S. LaSalle, Aurora, Ill. 60505

[21] Appl. No.: 818,289

[22] Filed: Jul. 25, 1977

[51] Int. Cl.[2] ..... E21C 11/02

[52] U.S. Cl. ..... 173/27; 173/43

[58] Field of Search ..... 173/22, 27, 43

[56] References Cited

U.S. PATENT DOCUMENTS

| | | | |
|---|---|---|---|
| 2,732,197 | 1/1956 | Cornett | 173/22 |
| 2,734,722 | 2/1956 | Pokorny | 173/27 |
| 2,852,992 | 9/1958 | Simmonds | 173/22 |
| 2,856,158 | 10/1958 | Richardson et al. | 173/26 |
| 2,940,267 | 6/1960 | Shaver | 173/27 |
| 3,447,613 | 6/1969 | Lisenby | 173/43 |
| 3,452,829 | 7/1969 | Smith | 173/43 |
| 3,507,338 | 4/1970 | McWaters et al. | 173/43 |
| 3,576,218 | 4/1971 | Lisenby | 173/43 |
| 3,731,751 | 5/1973 | Rusco | 173/26 |

*Primary Examiner*—Lawrence J. Staab

*Attorney, Agent, or Firm*—James E. Anderson

[57] ABSTRACT

A self-propelled posthole digging machine having a vertical drilling assembly mounted on one side thereof by means of an undercarriage frame attachment. This assembly comprises a vertical guide assembly which is movable laterally from the undercarriage and carries an axially movable and rotating auger unit, the vertical guide assembly being pivotally movable relative to a vertical reference to align the auger axis according to the slant of the hole to be drilled.

5 Claims, 5 Drawing Figures

POSTHOLE DIGGING APPARATUS

BACKGROUND OF THE INVENTION

1. Field of the Invention

This invention relates to self-propelled tractor units generally having augers mounted thereon and operable to drill holes in the earth for purposes of implanting fence posts, utility poles, piles, bulkheads and the like.

2. Background of the Invention

In commercial self-propelled (e.g., tractor-mounted) posthole diggers presently in common use, the auger unit typically is integrally attached at the rear of the tractor, and is essentially a single-purpose piece of construction equipment. The auger is horizontally fixed in relation to the tractor, and is movable downwardly during the drilling operation. In practice, the machine operator locates the auger over the hole location by maneuvering the tractor itself precisely into position. A large percentage of posthole digging operations involve the placement of long stretches of aligned holes for fencing or utility posts, which means that between successive holes the operator must drive forward to the next hole, then back up, while turning to look backward and forward, in order to position the auger; a second operator may also be stationed at the rear of the machine to manipulate the auger controls during drilling. Various situations may physically interfere with this backward and forward system of maneuvering machinery. Among them are ditches, railroad tracks, travelled highway, streams, building structures, boulders, pits, etc. Thus, in some cases the tractor may not be able to back up to precisely the intendee location of the hole. Furthermore, this system is inefficient and time consuming.

SUMMARY OF THE INVENTION

In accordance with the invention, a self-contained drilling assembly includes an undercarriage framework which can be mounted to the chasis of a standard tractor, and incorporates means for positioning the auger at one side of the tractor. Means are incorporated to extend the auger laterally from the tractor, move it upwardly and downwardly in alignment with progression of the hole drilling, and initially adjust its angular pitch relative to a vertical reference. Thus, a single operator can observe the drilling operation at one side, while progressing forwardly between successive holes without the need to back the tractor into precise position determined by location of the hole to be dug. The tractor may follow a wavering path around obstacles, while nevertheless maintaining a straight line of holes, by virtue of the ability to extend or retract the auger laterally at one side. Separate and more powerful motors incorporated in the self-contained auger assembly also enable the application of greater downpressure, or drilling force, in the auger, particularly when drilling holes in frozen soil, shale and the like. When drilling holes at an angle for bulkheads, or other purposes, the auger assembly can be extended outwardly over the hole location and pivoted to determine the vertical angularity of the auger.

DESCRIPTION OF THE PREFERRED EMBODIMENT

Figure 1:
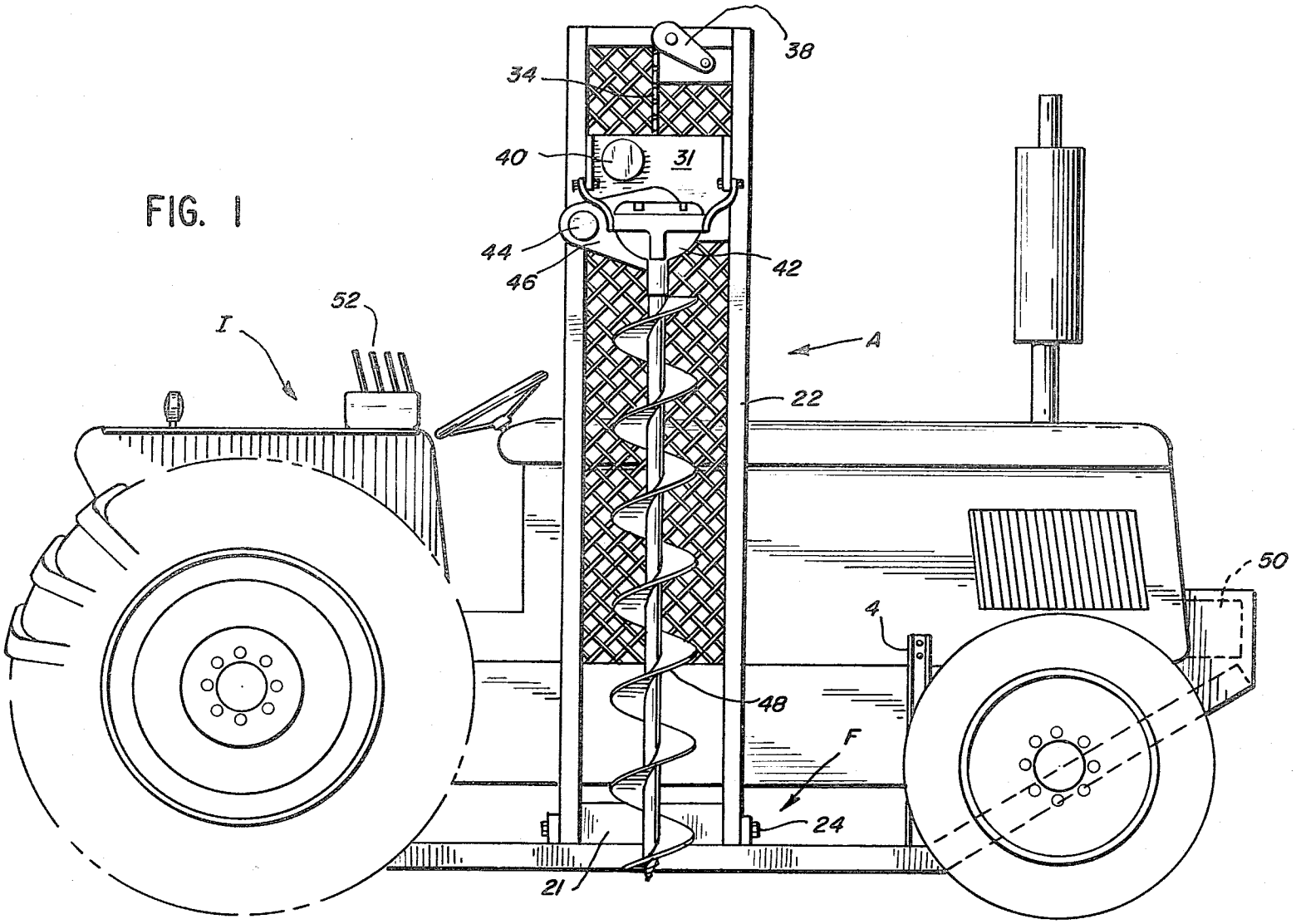
FIG. 1 is a right-hand side elevation of a tractor-mounted posthole drilling auger assembly in accordance with this invention.
Figure 2:
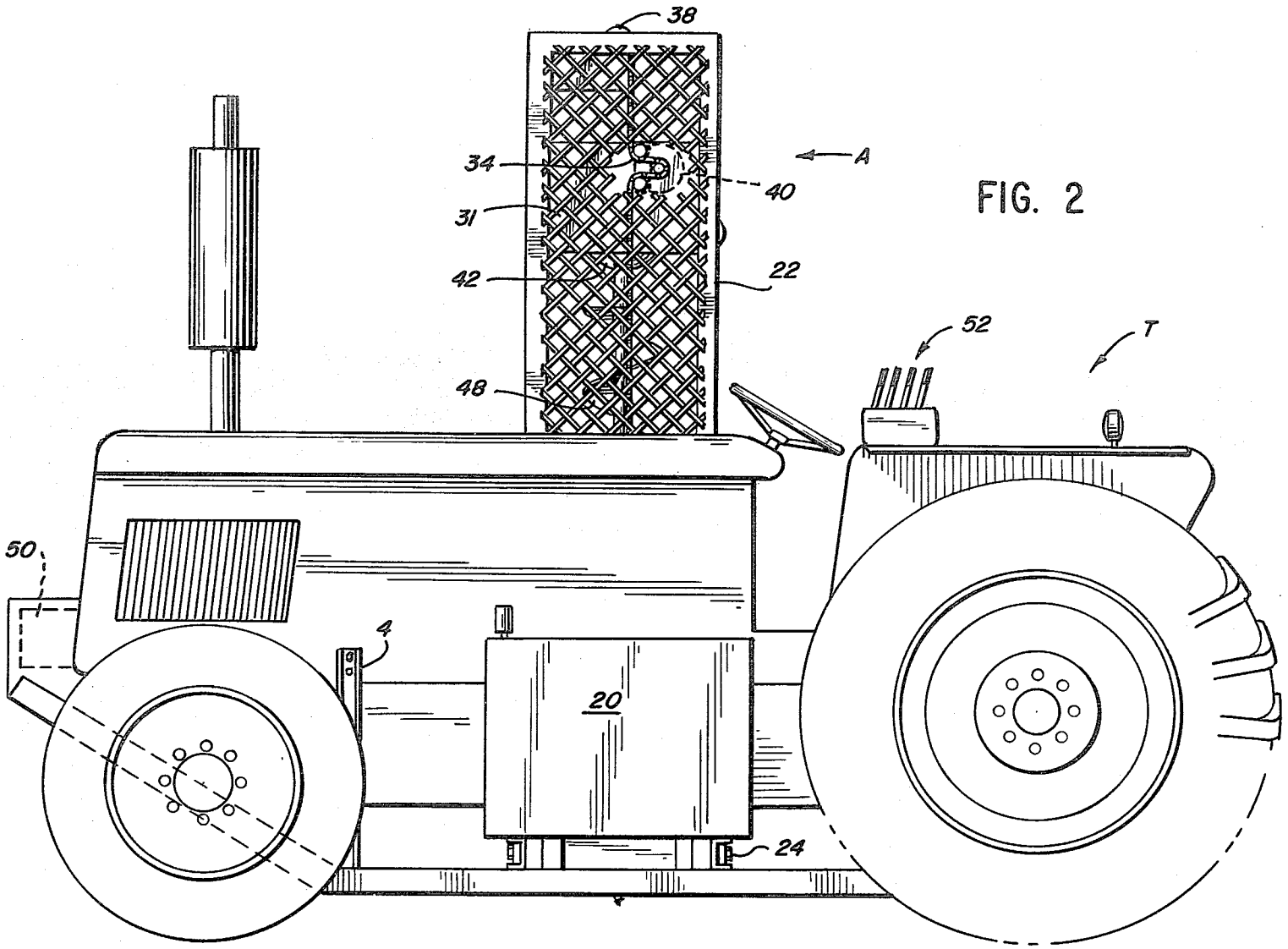
FIG. 2 is a left-hand side elevation of the tractor-mounted assembly shown in FIG. 1.

Referring particularly to FIGS. 1 and 2, there is shown a conventional general-purpose construction tractor, generally indicated at T, and a side-mounted posthole drilling tool assembly, generally indicated at A.

Figure 3:
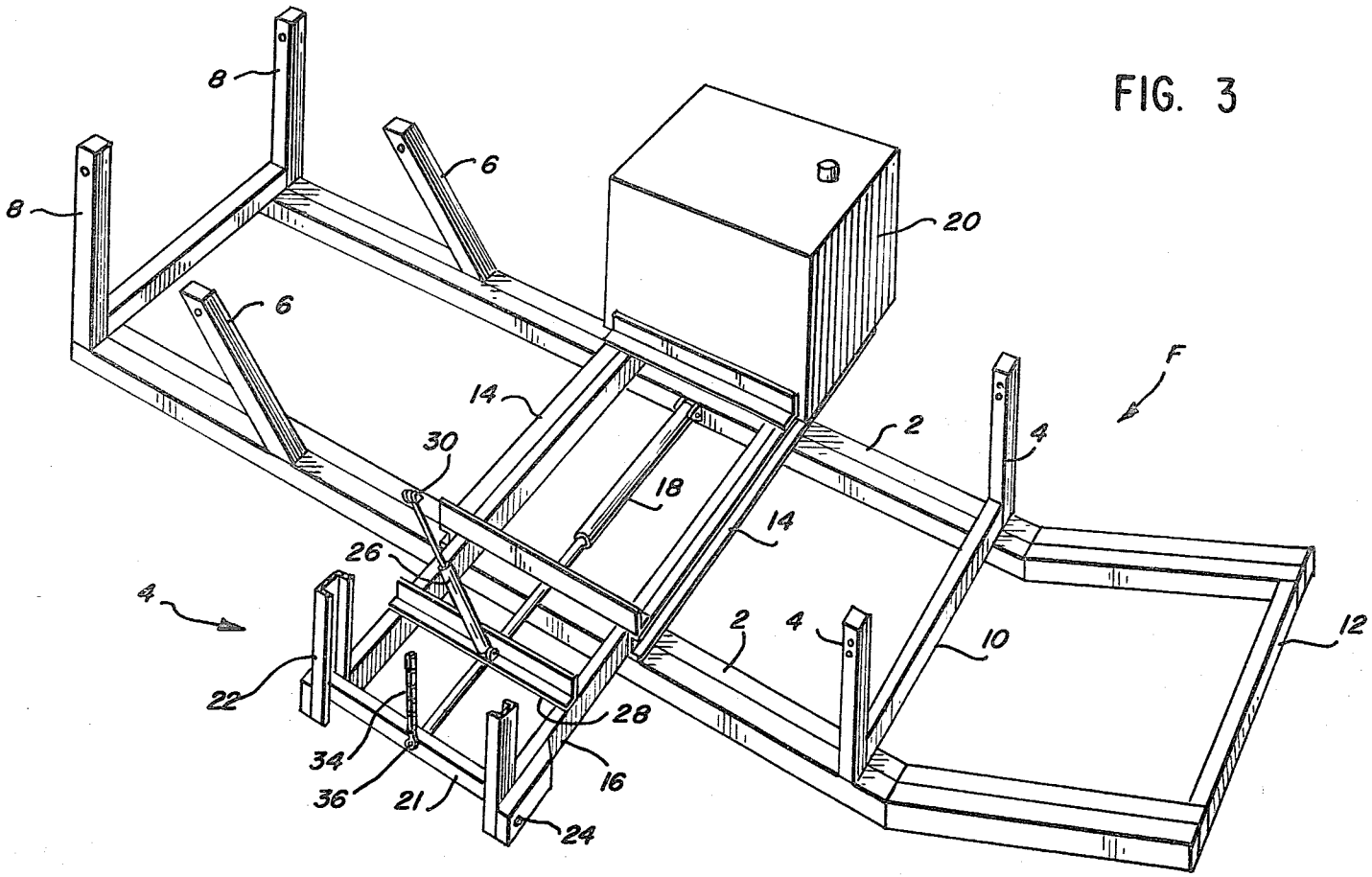
FIG. 3 is a perspective view of the detachable undercarriage frame which is mounted from beneath a standard tractor and supports the posthole drilling auger assembly.

Referring to FIG. 3, there is shown an integrally constructed undercarriage frame F, which is adaptable to mounting underneath a wide variety of standard tractor models by means of suitable brackets. The frame F comprises longitudinal steel channel beams 2 to which are affixed the upstanding forward mounting brackets 4, and rearward sets of mounting brackets 6 and 8. Brackets 4,6 and 8 are located and otherwise designed to adapt the frame F to be mounted on any particular commercially available model of tractor unit. The brackets 4, for example, are attached to the tractor chasis by bolts as indicated at 4' in FIG. 1. The two sides of the parallel steel beams 2 are spanned by weldments 10. At the front of the frame F, it is provided with a projecting bumper 12 which mainly serves to protect the forwardly mounted hydraulic motor 50, but also may be useful for pushing other vehicles.

Affixed across the beams 2 is a pair of guide channels 14, which accomodate a transverse slide assembly having rails 16. The reservoir 20 for the self-contained hydraulic system of the auger assembly is mounted across channels 14. The slide assembly further comprises a crossbar 21 affixed between the rails 16, and is reciprocably mounted by means of connection to a hydraulic piston and cylinder unit 18. A pair of rails 22 forms a verticle guide assembly which is pivotally mounted on the transverse slide rails 16 as indicated at 24. Pivotal operation of the vertical slide rails 22 is effected by another hydraulic piston and cylinder unit 26, connected between a crossbar 28 on rails 16, and a pivot connection 30 on rails 22.

A slide 32 is vertically guided within the rails 22, and is driven through a chain 34 running between anchor mounting 36 on crossbar 21 and a chain slack adjustment lever 38 at the top of the vertical guide assembly. Chain 34 is driven through sprockets by hydraulic motor 40 mounted on slide 32. Also mounted on slide 32 is a gearbox 42, which drives an auger 48 and is powered by a 35 gal./min hydraulic pump 44 through means of a transmission box 46.

The main pump 50 for the overall hydraulic system is mounted at the front of the tractor and is driven from the tractor's main crankshaft. The valves controlling the functions of the hydraulic system are operated by a set of levers 52 located within reach of the machine operator. The valves, pumps, motors and other components of a hydraulic system for operating the unit are standard off-the-shelf items and therefore need not be described in further detail in order to comprehend the invention.

Figure 5:
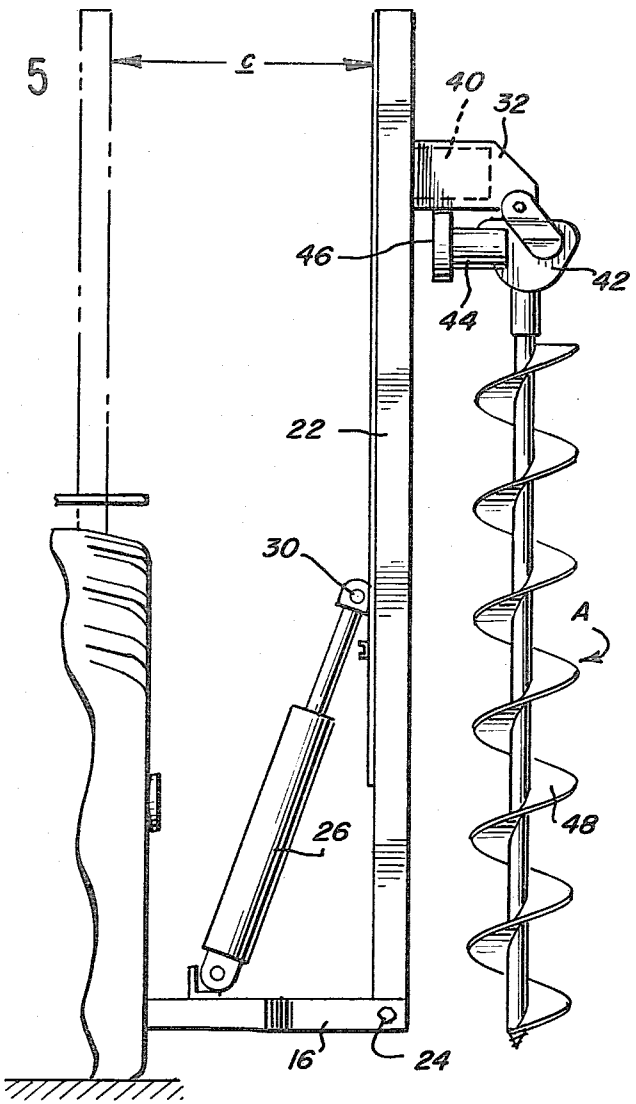
FIGS. 4 and 5 are partial front and back sideviews, respectively, of the auger assembly, and illustrate its ranges of movement.
Figure 4:
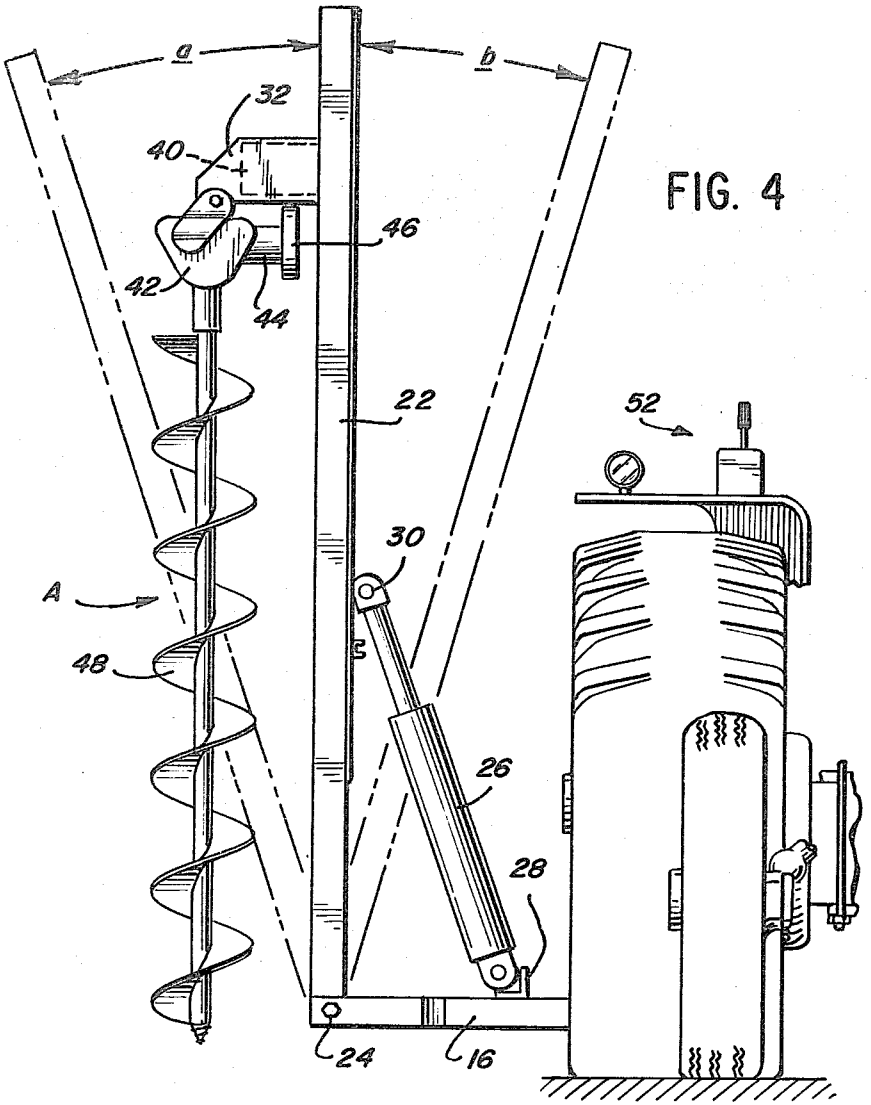

As indicated in FIGS. 4 and 5, the drilling unit can be tilted forwardly through angle a and also tilted backwardly through angle b; it also can be extended outwardly through a distance c, which is dependant upon the width of the tractor and the stroke of the transverse slide assembly 16.

In review of the operation of the posthole drilling unit in accordance with this invention, the operator of tractor T can drive forwardly between successive hole locations; at each location he need not back up to it nor otherwise place strict dependence on where he is able to maneuver the vehicle. Through a combination of manipulations of the transverse slide assembly 16, pivotal guides 22 and vertical slide 32, the operator can usually place the auger over the hole location without further movement of the tractor. In actual practice it has been demonstrated that a side-mounted unit as thus constructed and operated can complete the drilling of a greater number of holes per unit of time, as compared to rear-mounted auger units. The tractor itself need not follow a straight post line, and affords greater accessibility to desired hole locations. Because the main hydraulic pump 50 and its reservoir 20 are independent of the usually smaller capacity hydraulic system of the main tractor, considerable downpressure can be applied to the auger 48 during drilling, thereby speeding the drilling operation.

I claim:

1. A posthole digging attachment for a tractor unit, comprising an undercarriage frame having side members adapted to be attached lengthwise beneath the chassis of a tractor; brackets extending outwardly from said side members at locations adapted for attachment to said chassis of a tractor at corresponding locations along its length; means for detachably connecting said brackets to a said chassis; a slide assembly incorporated in said framework and comprising a structure movable inwardly and outwardly in a lateral direction relative to the length of said frame; a vertical guide assembly pivotally connected to the outwardly extended portion of said structure and adjustable about a horizontal axis parallel to said length of the frame; a rotary drilling tool slidably mounted on said vertical guide assembly for vertical movement of the tool; and drive means for pivotally adjusting said vertical guide assembly, vertically moving said drilling tool, and moving said vertical guide assembly inwardly and outwardly said slide assembly, vertical guide assembly and drive means being disposed outside an unobstructed space provided within said side members and brackets to cradle and accomodate said chassis of the tractor.

2. An attachment according to claim 1, wherein said means for moving the vertical guide assembly inwardly and outwardly, said means for pivotally adjusting the tilt of the vertical guide assembly, and said means for driving the drilling tool, comprise a self-contained system of hydraulic motors independently associated with said attached framework and vertical guide assembly, being separated from the auxiliary hydraulic system of the tractor unit.

3. An attachment according to claim 1, wherein said vertical guide assembly comprises a pair of vertical rails, said slide being mounted on said rails for vertical movement of the drilling tool, and said pair of rails being pivotally connected at their lower ends to a transverse slide assembly comprising the means for moving the vertical guide assembly transversely.

4. An attachment according to claim 1, wherein said brackets extend upwardly from said frame members and are pre-drilled to be detachably connected to a tractor chassis by bolts.

5. A posthole digging attachment for a tractor unit, comprising an undercarriage frame having side members adapted to be attached lengthwise beneath the chassis of a tractor; brackets extending outwardly from said side members at locations adapted for attachment to said chassis of a tractor at corresponding locations along its length; means for detachably connecting said brackets to a said chassis; a slide assembly incorporated in said framework and comprising a structure movable inwardly and outwardly in a lateral direction relative to the length of said frame; a vertical guide assembly pivotally connected to the outwardly extended portion of said structure and adjustable about a horizontal axis parallel to said length of the frame; a rotary drilling tool slidably mounted on said vertical guide assembly for vertical movement of the tool; a hydraulic pump mounted at the front end of the undercarriage and adapted to be coupled to the driving engine of a tractor; a hydraulic fluid reservoir mounted on one side of said undercarriage frame; and hydraulic motors on said slide and vertical assemblies; said pump, reservoir and motors comprising a self-contained hydraulic system for pivotally adjusting said vertical guide assembly, vertically moving said driving tool, and moving said vertical guide assembly inwardly and outwardly.

* * * * *